US006939087B2

(12) United States Patent
Ruel

(10) Patent No.: US 6,939,087 B2
(45) Date of Patent: Sep. 6, 2005

(54) SYSTEMS AND METHODS FOR CONNECTING REINFORCING MESH TO WALL PANELS

(75) Inventor: Steven V. Ruel, San Jose, CA (US)

(73) Assignee: SSL, LLC, Scotts Valley, CA (US)

( * ) Notice: Subject to any disclaimer, the term of this patent is extended or adjusted under 35 U.S.C. 154(b) by 0 days.

(21) Appl. No.: 10/781,967

(22) Filed: Feb. 18, 2004

(65) Prior Publication Data

US 2004/0179902 A1 Sep. 16, 2004

Related U.S. Application Data

(63) Continuation-in-part of application No. 10/370,637, filed on Feb. 19, 2003.

(51) Int. Cl.[7] ..... E02D 29/02
(52) U.S. Cl. ..... 405/286; 405/284; 405/262
(58) Field of Search ..... 405/262, 286, 405/284

(56) References Cited

U.S. PATENT DOCUMENTS

| | | | |
|---|---|---|---|
| 979,285 | A | 12/1910 | Gilligan |
| 3,631,682 | A | 1/1972 | Hilfiker et al. |
| 3,992,864 | A | 11/1976 | Igel |
| 4,068,482 | A | 1/1978 | Hilfiker |
| 4,117,686 | A | 10/1978 | Hilfiker |
| 4,154,554 | A | 5/1979 | Hilfiker |
| 4,260,296 | A | 4/1981 | Hilfiker |
| 4,266,890 | A | 5/1981 | Hilfiker |
| 4,324,508 | A | 4/1982 | Hilfiker et al. |
| 4,329,089 | A | 5/1982 | Hilfiker et al. |
| 4,343,572 | A | 8/1982 | Hilfiker et al. |
| 4,391,557 | A | 7/1983 | Hilfiker et al. |
| 4,407,611 | A | 10/1983 | Murray et al. |
| 4,449,857 | A | 5/1984 | Davis |
| 4,505,621 | A | 3/1985 | Hilfiker et al. |
| 4,529,174 | A | 7/1985 | Pickett |
| 4,616,959 | A | 10/1986 | Hilfiker |
| 4,643,618 | A | 2/1987 | Hilfiker et al. |
| 4,661,023 | A | 4/1987 | Hilfiker |
| 4,684,287 | A | 8/1987 | Wojciechowski |
| 4,815,897 | A | 3/1989 | Risi et al. |
| 4,824,293 | A | 4/1989 | Brown et al. |
| 4,834,584 | A | 5/1989 | Hilfiker |
| 4,856,939 | A | 8/1989 | Hilfiker |
| 4,929,125 | A | 5/1990 | Hilfiker |
| 4,952,098 | A | 8/1990 | Grayson et al. |
| 4,961,673 | A | 10/1990 | Pagano et al. |
| 4,992,005 | A | 2/1991 | Hilfiker |
| 4,993,879 | A | 2/1991 | Hilfiker |
| 5,017,050 | A | 5/1991 | Jaecklin |

(Continued)

FOREIGN PATENT DOCUMENTS

| | | |
|---|---|---|
| GB | 2059484 | 4/1981 |
| JP | 2-261122 | * 10/1990 |
| JP | 91-107521/15 | 3/1991 |

*Primary Examiner*—Sunil Singh
(74) *Attorney, Agent, or Firm*—Michael R. Schacht; Schacht Law Office, Inc.

(57) ABSTRACT

A retaining wall system for stabilizing an earthen wall. The retaining wall system comprises a panel structure, an anchor mesh panel, and a lock member. The wall panel defines an exposed face and a rear face. An insert is partly embedded within the wall panel such that a portion of the insert is spaced from the rear face of the wall panel to define a lock opening. The anchor mesh panel comprises at least one tension member defining an anchor axis. The tension member is bent at a first edge location to define a bearing portion. The lock member is inserted through the lock opening to engage the tension member and the insert to inhibit relative movement between the anchor mesh panel and the wall panel.

13 Claims, 5 Drawing Sheets

U.S. PATENT DOCUMENTS 5,028,172 A 7/1991 Wilson et al.
5,044,833 A 9/1991 Wilfiker
5,064,313 A 11/1991 Risi et al.
5,076,735 A 12/1991 Hilfiker
5,158,399 A 10/1992 Flores
5,190,413 A 3/1993 Carey
5,259,704 A 11/1993 Orgorchock
5,484,235 A 1/1996 Hilfiker
5,492,438 A 2/1996 Hilfiker
5,494,379 A 2/1996 Anderson et al.
5,511,910 A 4/1996 Scales
5,531,547 A 7/1996 Shimada
5,564,865 A 10/1996 Jansson
5,622,455 A 4/1997 Anderson et al.
5,642,968 A 7/1997 Anderson et al.
5,647,695 A 7/1997 Hilfiker et al.
5,671,582 A 9/1997 Reay
5,722,799 A 3/1998 Hilfiker
5,749,680 A 5/1998 Hilfiker et al.
5,820,305 A 10/1998 Taylor et al.
5,975,810 A * 11/1999 Taylor et al. ..... 405/262
6,050,748 A 4/2000 Anderson et al.
6,086,288 A 7/2000 Ruel et al.
6,113,317 A 9/2000 Myers
6,186,703 B1 * 2/2001 Shaw ..... 405/262
6,402,435 B1 6/2002 Lewis

* cited by examiner

SYSTEMS AND METHODS FOR CONNECTING REINFORCING MESH TO WALL PANELS

RELATED APPLICATIONS

This application is a continuation-in-part of U.S. patent application Ser. No. 10/370,637 filed on Feb. 19, 2003.

TECHNICAL FIELD

The present invention relates to stabilized earthen walls and, more specifically, to a stabilized earthen wall having pre-cast concrete face panels that define a vertical wall face surface.

BACKGROUND OF THE INVENTION

Construction projects often require the formation of vertical or nearly vertical earthen walls. For example, the side of a hill may be excavated to obtain a suitable road grade, leaving a substantially vertical wall face on the uphill side of the road. Depending upon the composition of the earth, stabilization may be required to prevent degradation or collapse of the face of the earthen.

Earthen walls are stabilized using numerous methods. In some situations, a light coating or wire mesh may be applied to the face of the wall to prevent loose dirt and rocks from falling from the exposed wall face. In other situations, the face of the earthen wall may be stabilized by constructing a substantially freestanding wall and backfilling the earth against the freestanding wall. Such freestanding walls are commonly made of materials such as wood or concrete. Wood or concrete may be in the form of blocks or piles that are assembled on site; a freestanding concrete wall may also be cast in place.

In many situations, the earthen wall may require stabilization beyond what can be obtained by a coating, wire mesh, or a freestanding wall. In these cases, the reinforcing wall may be mechanically connected to the earthen wall. This type of reinforcing wall will be referred to herein as a mechanically stabilized earthen wall.

A mechanically stabilized earthen wall typically comprises a substantially vertical face wall and one or more substantially horizontal anchor members connected to the face wall and buried within the earthen wall. The face wall protects the face of the earthen wall, while the anchor members reinforce the face wall.

The present invention relates to mechanically stabilized earthen walls comprising pre-cast concrete panels that form the vertical face surface of the wall.

SUMMARY OF THE INVENTION

The present invention may be embodied as a retaining wall system for stabilizing an earthen wall. The retaining wall system comprises a panel structure, an anchor mesh panel, and a lock member. The wall panel defines an exposed face and a rear face. An insert is partly embedded within the wall panel such that a portion of the insert is spaced from the rear face of the wall panel to define a lock opening. The anchor mesh panel comprises at least one tension member defining an anchor axis. The tension member is bent at a first edge location to define a bearing portion. The lock member is inserted through the lock opening to engage the tension member and the insert to inhibit relative movement between the anchor mesh panel and the wall panel.

DETAILED DESCRIPTION OF THE INVENTION

Figure 2:
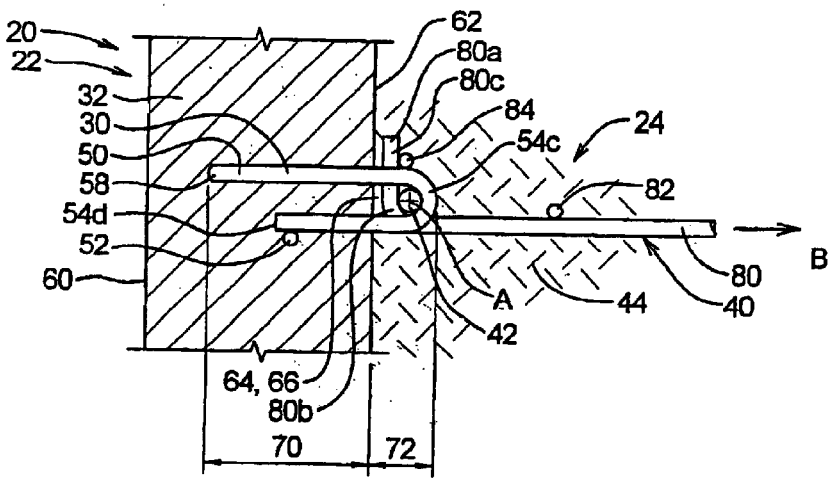
FIG. 2 is a side elevation section view of a wall system comprising the wall insert of FIG. 1 embedded within a wall panel.
Figure 3:
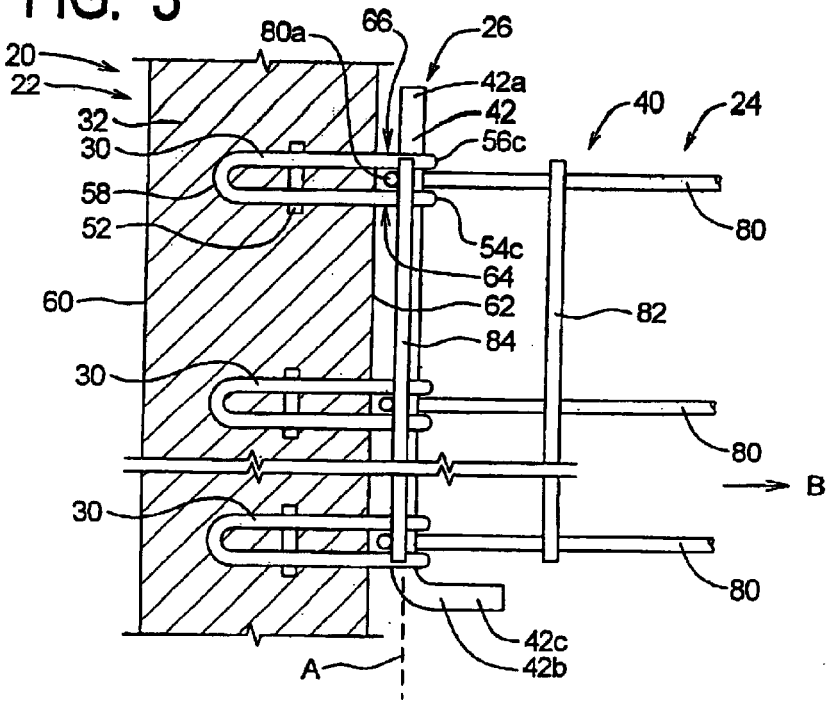
FIG. 3 is a top plan view of wall system of FIG. 2.
Figure 4:
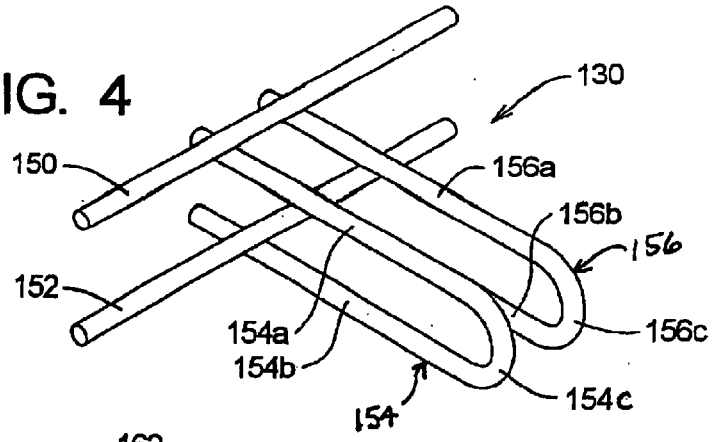
FIG. 4 is a perspective view of another exemplary wall insert constructed in accordance with, and embodying, the principles of the present invention.

Referring initially to FIGS. 2 and 3, depicted therein is a first exemplary retaining wall system 20 constructed in accordance with, and embodying, the principles of the present invention. The retaining wall system 20 comprises a panel structure 22 and an anchor structure 24 connected together by a locking system 26.

The panel structure 22 comprises at least one insert 30 and a wall panel 32. The wall panel 32 is typically made of concrete. The inserts 30 are partly embedded within the concrete wall panel 32 such that each insert 30 is at a predetermined location on the panel 32. Typically, a plurality of inserts 30 are embedded within each wall panel 32. In addition, the inserts 30 are typically arranged at least two vertical levels when the wall system 20 is formed.

The anchor structure 24 comprises an anchor panel 40. The anchor panel 40 is typically a metal structure that is buried within an earthen wall 44.

The locking system 26 comprises a locking pin 42. The locking pin 42 is typically a metal bar.

In use, the panel structure 22 is arranged at a desired location. An earthen wall 44 is formed by backfilling dirt against the wall panel 32. When dirt is backfilled to approximately the vertical level of the insert 30, an anchor panel 40 is arranged on the dirt in a predetermined relationship to the insert 30. The locking pin 42 is then displaced such that the pin 42 engages the insert 30 and the anchor panel 40 to form the locking system 26 that inhibits relative displacement of the wall panel 32 relative to the anchor panel 40. This process is repeated until the earthen wall 44 reaches a desired level relative to the retaining wall system 20. One or more anchor panels 40 are thus typically provided for one or more of the inserts 30 at each vertical level.

Figure 1:
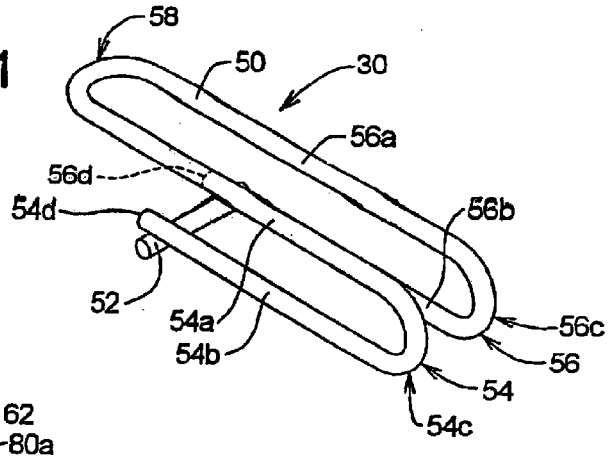
FIG. 1 is a perspective view of an exemplary wall insert constructed in accordance with, and embodying, the principles of the present invention.

Referring now to FIG. 1, the exemplary insert 30 is a welded structure comprising first and second rods 50 and 52. The first rod 50 is bent to form first and second side portions 54 and 56 and a connecting portion 58. The connecting portion 58 is formed by a 180° bend in the first rod 50 that extends between the side portions 54 and 56.

The side portions 54 and 56 comprise upper bar portions 54*a* and 56*a*, lower bar portions 54*b* and 56*b*, and first and second corner portions 54*c* and 56*c*. The upper and lower bar portions 54*a*, 56*a* and 54*b*, 56*b* are substantially straight and substantially parallel to each other. The first and second corner portions 54*c* and 56*c* are formed by 180° bends in the first rod 50. The lower bar portions 54*b* and 56*b* define first and second bar ends 54*d* and 56*d*, respectively.

The second rod 52 is a straight bar that is welded to the lower bar portions 54*b* and 56*b* adjacent to the first and second bar ends 54*d* and 56*d*. Alternatively, an additional 90° bend may be formed in each of the lower bar portions 54*b* and 56*b* such that the first and second bar ends 54*d* and 56*d* may be welded together. In lower load situations, the second rod 52 may be omitted, leaving the bar ends 54*d* and 56*d* unconnected.

The wall panel 32 defines an exposed face 60 and a rear face 62. The inserts 30 are embedded within the panel 32 such that the connecting portion 58 and the bar ends 54*d* and 56*d* are within the panel 32 and the first and second corner portions 54*c* and 56*c* are outside of the panel 32. The upper and lower bar portions 54*a*, 56*a* and 54*b*, 56*b* of the side portions 54 and 56 intersect the rear face 62 of the panel 32. The first and second corner portions 54*c* and 56*c* are thus accessible at the rear face 62 of the wall panel 32. The inserts 30 are not visible from the exposed face 60.

First and second lock openings 64 and 66 are formed by each of the inserts 30 and the rear face 62 of the wall panel 32. In particular, FIGS. 2 and 3 show that, when embedded within the wall panel 32, the inserts define an embedded portion 70 and an exposed portion 72. The embedded portion 70 comprises the second rod 52, part of the upper and lower portions 54*a*, 54*b* and 56*a*, 54*b*, and the connecting portion 58. The exposed portion 72 comprises part of the upper and lower portions 54*a*, 54*b* and 56*a*, 54*b* and the corner portions 54*c* and 56*c*. In conjunction with the rear face 62, the exposed portion 72 defines the lock openings 64 and 66. The lock openings 64 and 66 define a lock axis A.

The anchor panel 40 defines an anchor axis B. The anchor panel 40 may be any structure that, when connected to the insert 30, is capable of preventing movement of the insert 30 relative to the earthen wall under predetermined loads. Typically, the anchor panel 40 is a mesh material made of welded rods. The exemplary anchor panel 40 comprises a plurality of tension rods 80 and plurality of lateral rods 82 welded across the tension rods 80. Dirt forming the earthen wall 44 lies in openings defined by the tension and lateral rods 80 and 82 to inhibit movement of the anchor panel 40 relative to the earthen wall 44.

In addition, the anchor panel 40 comprises a bearing bar 84 welded to the tension rods 80. In particular, the tension rods 80 define proximal ends 80*a* that are, in use, adjacent to the wall panel 32. The tension rods 80 are bent at edge locations 80*b* adjacent to the proximal ends 80*a* to define bearing portions 80*c* of the tension rods 80. The bearing portions 80*c* extend at an angle of approximately 90° in the exemplary system 20, but this angle could be within a first range of approximately 85° to 95° and in any event should be within a second preferred range of approximately 20° to 105°. The bearing bar 84 is welded to the bearing portions 80*c* between the edge locations 80*b* and the proximal ends 80*a*. As will be described further below, the bearing bar 84 engages the inserts 30 to fix a location of the anchor panel 40 relative to the wall panel 32.

The locking pin 42 is an elongate steel bar having first and second ends 42*a* and 42*b*. The exemplary locking pin 42 is bent adjacent to the second end 42*b* to form a handle portion 42*c*.

The formation of the locking system 26 that connects the wall panel 32 and the anchor panel 40 will now be described in further detail. The anchor panel 40 is arranged such that the bearing bar 84 is adjacent to the rear face 62 of the wall panel 32. The bearing portions 80*c* of the tension rods 80 are located between the corner portions 54*c*, 56*c* of the inserts 30 and the rear face 62 of the panel 32.

The handle portion 42*c* of the locking pin 42 is then grasped to displace the locking pin 42 along the lock axis A relative to at least one of the insert members 30 and the anchor panel 40. The first end 42*a* thus passes through the lock openings 64 and 66 between the corner portions 54*c* and 56*c* of the insert 30 and the bearing portions 80*c* of the tension rods 80.

At this point, the locking pin 42 engages the bearing portions 80*c* of the tension rods 80 to prevent movement of the tension rods 80 in the direction of the anchor axis B relative to wall panel 32. The bearing bar 84 engages the insert members 30 to prevent the tension rods 80 from straightening and pulling out from behind the locking pin 42. The locking system 26 thus forms a rigid connection between the anchor panel 40 and the wall panel 32 under normal anticipated loads.

Figure 5:
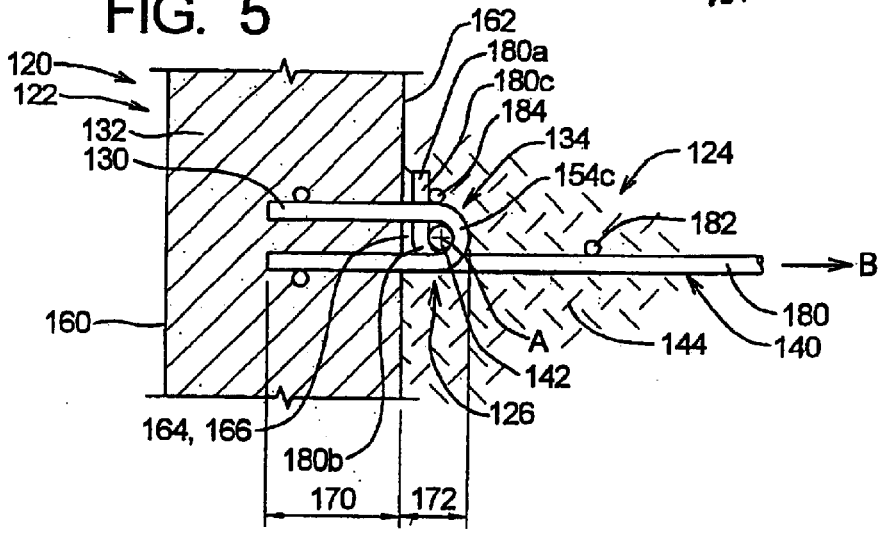
FIG. 5 is a side elevation section view of a wall system comprising the wall insert of FIG. 4 embedded within a wall panel.
Figure 6:
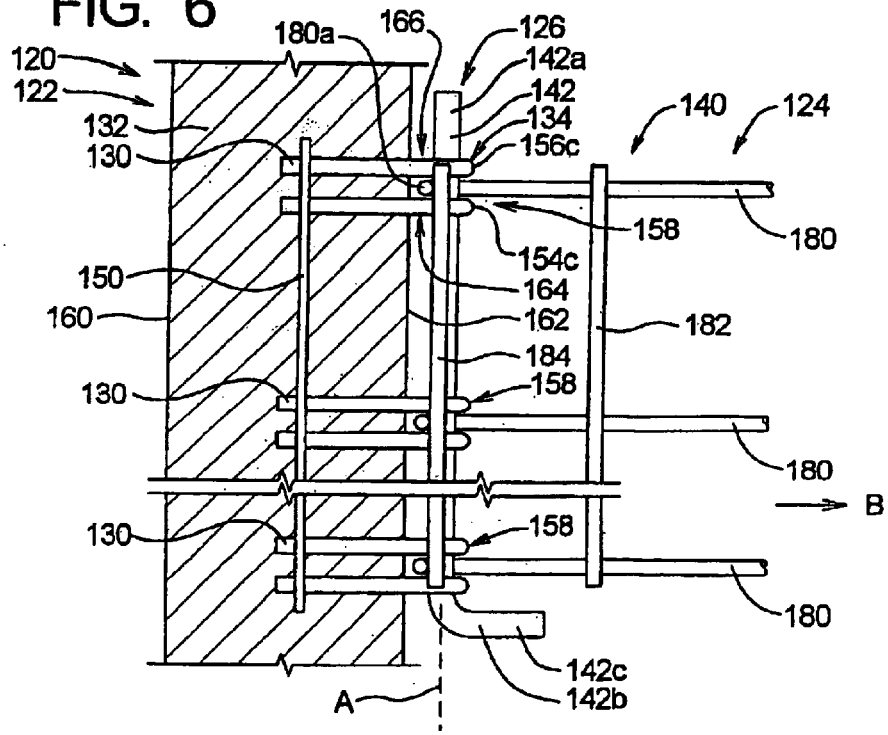
FIG. 6 is a top plan view of the wall system of FIG. 5.

Referring now to FIGS. 5 and 6, depicted therein is a second exemplary retaining wall system 120 constructed in accordance with, and embodying, the principles of the present invention. The retaining wall system 120 comprises a panel structure 122 and an anchor structure 124 connected together by a locking system 126.

The panel structure 122 comprises at least one insert structure 130 and a wall panel 132. The wall panel 132 is typically made of concrete. The insert structure 130 is partly embedded within the concrete wall panel 132 such that one or more insert projections 134 are formed at predetermined locations on the panel 132. Typically, a plurality of insert structures 130 are embedded within each wall panel 132. In addition, the insert projections 134 are typically arranged at least two vertical levels when the wall system 120 is formed.

The anchor structure 124 comprises an anchor panel 140. The anchor panel 140 is typically a metal structure that is buried within an earthen wall 144.

The locking system 126 comprises a locking pin 142. The locking pin 142 is typically a metal bar.

In use, the panel structure 122 is arranged at a desired location. An earthen wall 144 is formed by backfilling dirt against the wall panel 132. When dirt is backfilled to approximately the vertical level of the insert 130, an anchor panel 140 is arranged on the dirt in a predetermined relationship to the insert 130. The locking pin 142 is then displaced such that the pin 142 engages the insert 130 and the anchor panel 140 to form the locking system 126 which inhibits relative displacement of the wall panel 132 relative to the anchor panel 140. This process is repeated until the earthen wall 144 reaches a desired level relative to the retaining wall system 120. One or more anchor panels 140 are thus provided for the one or more insert projections 134 at each vertical level.

The exemplary insert 130 is a welded structure comprising first, second, third, and fourth rods 150, 152, 154, and 156. The first and second rods 150 and 152 are straight rods. The second and third rods 154 and 156 are bent to form upper and lower straight portions 154*a* and 154*b* and 156*a* and 156*b* and corner portions 154*c* and 156*c*. The first rod 150 is welded to the upper portions 154*a* and 156*a* of the first and second rods 154 and 156; similarly, the second rod 152 is welded to the lower portions 154*b* and 156*b* of the first and second rods 154 and 156. Typically, but not necessarily, a plurality of pairs 158 of third and fourth rods 154 and 156 are welded to the first and second rods 150 and 154 as shown in FIG. 6.

The exemplary corner portions 154*c* and 156*c* are formed by 180° bends in the first and second rods 154 and 156. The upper and lower bar portions 154*a*, 154*b* and 156*a*, 156*b* are, in the preferred system 120 parallel to each other. Similarly, the first and second rods 150 and 152 are preferably parallel to each other and perpendicular to the bar portions 154*a*, 154*b* and 156*a*, 156*b*.

The wall panel 132 defines an exposed face 160 and a rear face 162. The insert structure 130 is embedded within the panel 132 such that the first and second rods 150 and 152 are within the panel 132 and the first and second corner portions 154*c* and 156*c* are outside of the panel 132. The upper and lower bar portions 154*a*, 156*a* and 154*b*, 156*b* intersect the rear face 162 of the panel 132. The first and second corner portions 154*c* and 156*c* of the insert projections 134 are thus accessible at the rear face 162 of the wall panel 132. The insert structure 130 is not visible from the exposed face 160.

First and second lock openings 164 and 166 are formed by each of the insert structures 130 and the rear face 162 of the wall panel 132. In particular, FIGS. 5 and 6 show that, when embedded within the wall panel 132, the insert structures 130 define an embedded portion 170 and an exposed portion 172. The embedded portion 170 comprises the first and second rods 150 and 152 and part of the upper and lower portions 154*a*, 154*b* and 156*a*, 156*b*. The exposed portion 72 comprises part of the upper and lower portions 154*a*, 154*b* and 156*a*, 156*b* and the corner portions 154*c* and 156*c*. The rear face 162 and the exposed portion 172 define the lock openings 164 and 166. The lock openings 164 and 166 define a lock axis A.

The anchor panel 140 defines an anchor axis B. The anchor panel 140 may be any structure that, when connected to the insert 130, is capable of preventing movement of the insert 130 relative to the earthen wall under predetermined loads. Typically, the anchor panel 140 is a mesh material made of welded rods. The exemplary anchor panel 140 comprises a plurality of tension rods 180 and plurality of lateral rods 182 welded across the tension rods 180. Dirt forming the earthen wall 144 lies in openings defined by the tension and lateral rods 180 and 182 to inhibit movement of the anchor panel 140 relative to the earthen wall 144.

In addition, the anchor panel 140 comprises a bearing bar 184 welded to the tension rods 180. In particular, the tension rods 180 define proximal ends 180*a* that are, in use, adjacent to the wall panel 132. The tension rods 180 are bent at edge locations 180*b* adjacent to the proximal ends 180*a* to define bearing portions 180*c* of the tension rods 180. The bearing portions 180*c* extend at an angle of approximately 90° in the exemplary system 120, but this angle could be within a first range of approximately 185° to 95° and in any event should be within a second preferred range of approximately 120° to 105°. The bearing bar 184 is welded to the bearing portions 180*c* between the edge locations 180*b* and the proximal ends 180. As will be described further below, the bearing bar 184 engages the insert projections 134 to fix a location of the anchor panel 140 relative to the wall panel 132.

The locking pin 142 is an elongate steel bar having first and second ends 142*a* and 142*b*. The exemplary locking pin 142 is bent adjacent to the second end 142*b* to form a handle portion 142*c*.

The formation of the locking system 126 that connects the wall panel 132 and the anchor panel 140 will now be described in further detail. The anchor panel 140 is arranged such that the bearing bar 184 is in contact with one of the upper or lower bar portions 154*a*, 154*b* and 156*a*, 156*b* of the insert projections 134. The bearing portions 180*c* of the tension rods 180 are located between the corner portions 154*c*, 156*c* and the rear face 162 of the panel 132.

The handle portion 142*c* of the locking pin 142 is then grasped to displace the locking pin 142 along the lock axis A relative to at least one of the insert projections 134 and the anchor panel 140. The first end 142*a* thus passes through the lock openings 164 and 166 between the corner portions 154*c* and 156*c* of the insert projections 134 and the bearing portions 180*b* of the tension rods 180.

At this point, the locking pin 142 engages the bearing portions 180*c* of the tension rods 180 to prevent movement of the tension rods 180 in the direction of the anchor axis B relative to wall panel 132. The bearing bar 184 engages the insert projections 134 to prevent the tension rods 180 from straightening and pulling out from behind the locking pin 142. The locking system 126 thus forms a rigid connection between the anchor panel 140 and the wall panel 132 under normal anticipated loads.

Figure 7:
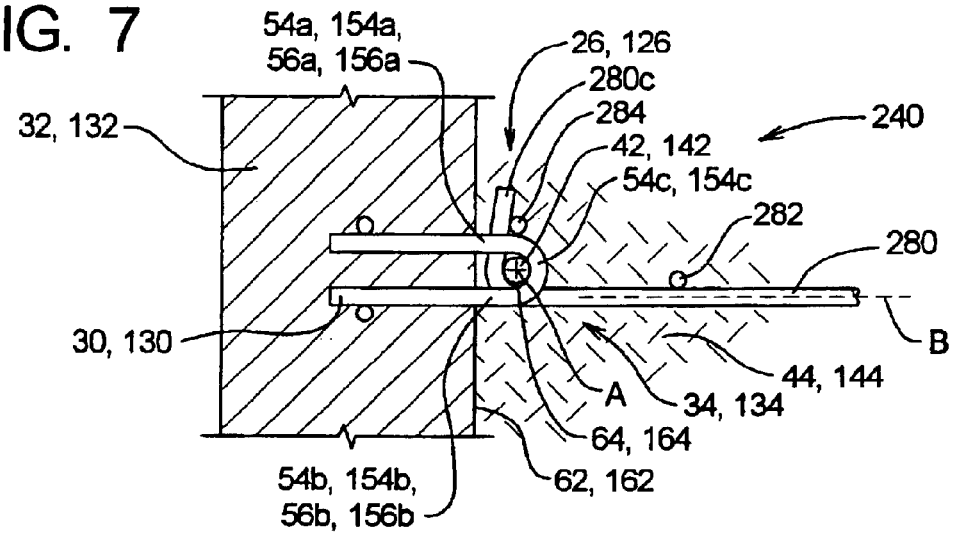
FIG. 7 is a side elevation view of a wall system comprising an insert embedded within a wall panel.
Figure 7A:
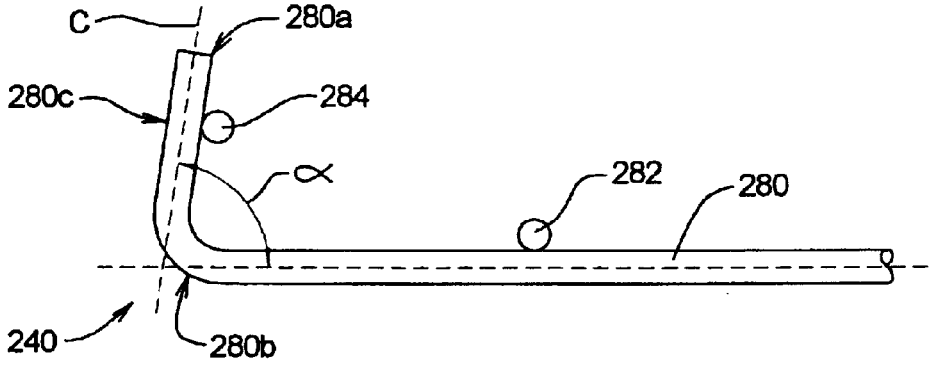
FIG. 7A is a side elevation view of the insert of FIG. 7.

Referring now to FIGS. 7 and 7A, depicted therein is another example of an anchor panel 240 that may be used in place of the anchor panels 40 or 140 as part of the retaining wall systems 20 and 120 described above. Like the anchor panels 40 and 140, the example anchor panel 240 is a mesh material made of welded rods and defines an anchor axis B. Any structure capable of preventing movement of the insert 30 or 130 relative to the earthen wall 44,144 under expected loads may be used to form the anchor panel 240.

The exemplary anchor panel 240 comprises a plurality of tension rods 280 and plurality of lateral rods 282 welded across the tension rods 280. Dirt forming the earthen wall 44,144 lies in openings defined by the tension and lateral rods 280 and 282 to inhibit movement of the anchor panel 240 relative to the earthen wall 44,144.

In addition, the anchor panel 240 comprises a bearing bar 284 welded to the tension rods 280. In particular, the tension rods 280 define proximal ends 280*a* that are, in use, adjacent to the wall panel 32, 132. Each tension rod 280 is bent at an edge location 280*b* that is adjacent to the proximal end 280*a* of the rods to define bearing portions 280*c* of the tension rods 280.

As perhaps best shown in FIG. 7A, the bearing portions 280*c* define a bearing axis C that extends at an angle $\alpha$ of approximately 82° from the anchor axis B. The angle $\alpha$ may be within a first range of approximately 77° to 87° and in any event should be within a second preferred range of at least approximately 72° to less than 90°.

The bearing bar 284 is welded to the bearing portions 280*c* between the edge locations 280*b* and the proximal ends 280. As with the bearing bars 84 and 184 described above, the bearing bar 284 engages the insert projections 34,134 to fix a location of the anchor panel 240 relative to the wall panel 32,132.

The method of using the example anchor panel 240 to form the locking systems 26 and 126 is substantially the same as the method of using the anchor panels 40 and 140 described above. The anchor panel 240 is arranged such that the bearing bar 284 is in contact with one of the upper or lower bar portions 54*a*,154*a*, 54*b*,154*b* and 56*a*,156*a*, 56*b*, 156*b* of the insert projections 34,134. The bearing portions 280*c* of the tension rods 280 are located between the corner portions 54*c*,154*c*, 56,156*c* and the rear face 62,162 of the panel 32,132.

The locking pin 42,142 is then grasped to displace the locking pin 42,142 along the lock axis A relative to at least one of the insert projections 34,134 and the anchor panel 40,140. The locking pin 42,142 thus passes through the lock openings 64,164 and 66,166 between the corner portions 54*c*,154*c* and 56*c*,156*c* of the insert projections 34,134 and the bearing portions 280*b* of the tension rods 280.

At this point, the locking pin 42,142 engages the bearing portions 280*c* of the tension rods 280 to prevent movement of the tension rods 280 in the direction of the anchor axis B relative to wall panel 32,132. The bearing bar 284 engages the insert projections 34,134 to prevent the tension rods 280 from straightening and pulling out from behind the locking pin 42,142. The locking system 26,126 thus forms a rigid connection between the anchor panel 240 and the wall panel 32,132 under normal anticipated loads.

It should be noted that the tolerances of the various components shown in FIG. 7 should be determined for a given set of operating conditions. These tolerances include the gauges or diameters of the metal bars used to form the insert 34,134, tension rods 280, and locking pin 42,142, the distance between the upper portions 54*a*,154*a* and 56*a*,156*a* and lower portions 54*b*,154*b* and 56*b*,156*b*, the distance between the rear face 62,162 and the corner portions 54*c*, 154*c* and 56*c*,156*c*, and the dimensions of the return portions 280*e*. In general, these tolerances should allow the locking pin 42,142 to be inserted along the lock axis A but not allow excessive movement of the insert 30,130 relative to the anchor panel 40,140 under expected loads. For clarity, the spaces between components of the locking system 26,126 resulting from the tolerances of the system 26,126 may be exaggerated in FIG. 7.

Figure 8:
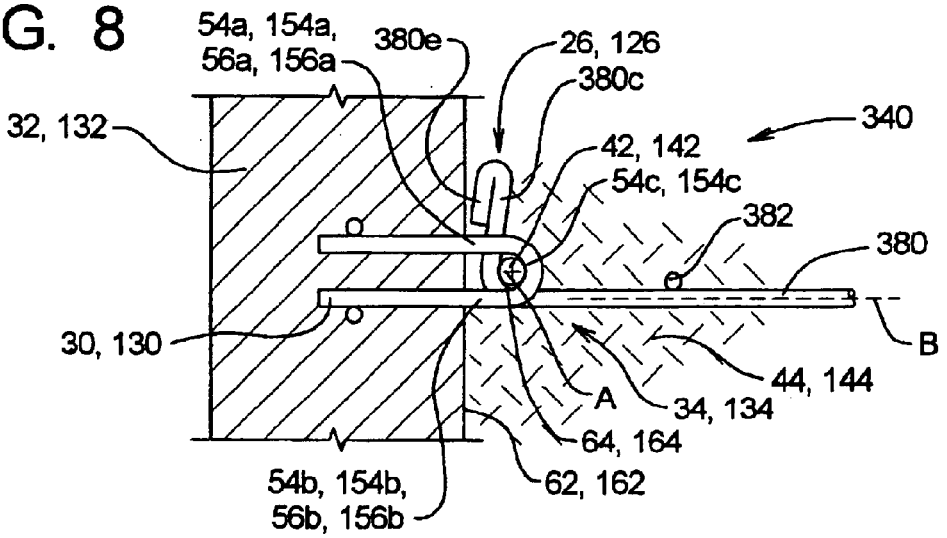
FIG. 8 is a side elevation view of a wall system comprising an insert embedded within a wall panel.
Figure 8A:
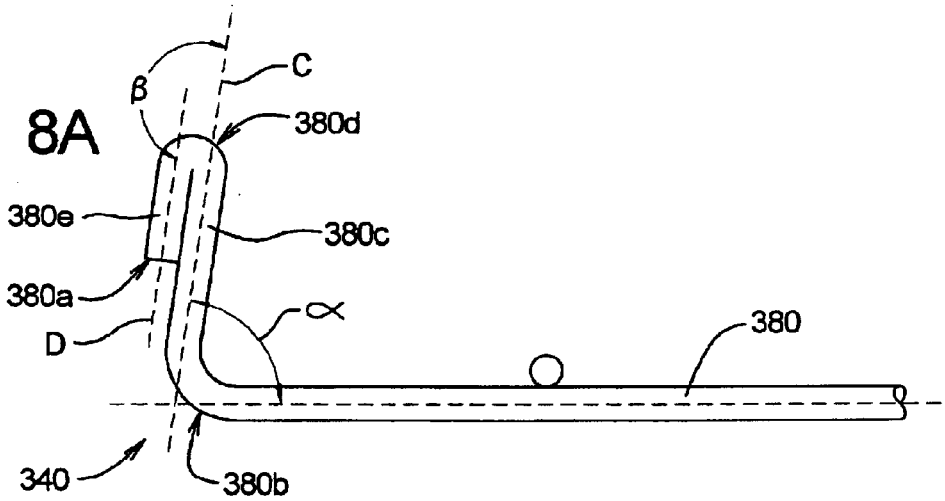
FIG. 8A is a side elevation view of the insert of FIG. 8.

Referring now to FIGS. 8 and 8A, depicted therein is another example of an anchor panel 340 that may be used in place of the anchor panels 40 or 140 as part of the retaining wall systems 20 and 120 described above. Like the anchor panels 40 and 140, the example anchor panel 340 is a mesh material made of welded rods and defines an anchor axis B. Any structure capable of preventing movement of the insert 30,130 relative to the earthen wall 44,144 under expected loads may be used to form the anchor panel 340.

The exemplary anchor panel 340 comprises a plurality of tension rods 380 and plurality of lateral rods 382 welded across the tension rods 380. Dirt forming the earthen wall 44,144 lies in openings defined by the tension and lateral rods 380 and 382 to inhibit movement of the anchor panel 340 relative to the earthen wall 44,144.

The tension rods 380 define proximal ends 380*a* that are, in use, adjacent to the wall panel 32,132. Each tension rod 380 is bent at a first edge location 380*b* that is adjacent to the proximal end 380*a* of the rods to define bearing portions 380*c* of the tension rods 380. In addition, the example tension rods 380 are bent at a second edge location 380*d* to define a return portion 380*e* of the tension rods 380. As will be described in further detail below, the use of the return portion 380*e* obviates the need for a bearing bar such as the bearing bars 84,184, and 284 described above.

As perhaps best shown in FIG. 8A, the bearing portions 380*c* define a bearing axis C that extends at an angle $\alpha$ of approximately 82° from the anchor axis B. The angle $\alpha$ may be within a first range of approximately 77° to 87° and in any event should be within a second preferred range of at least approximately 72° to less than 90°.

The tension rod 380 is bent at the second edge location 380*d* to define a return portion 380*e* that extends along a return axis D at an angle $\beta$ relative to the bearing axis C. The angle $\beta$ is preferably approximately 180° such that the return axis D is substantially parallel to the bearing axis C. The angle $\beta$ may be within a first range of approximately 170° to 200° and in any event should be within a second preferred range of at least approximately 160° to at most approximately 210°. In any case, the return portion 380*e* of the tension rod 380 may be bent of to one side or the other of the bearing portion 380*c*; if the angle $\beta$ is greater than 180°, the return portion 380*e* of the tension rod 380 must be bent to one side or the other of the bearing portion 380*c*.

The method of using the example anchor panel 340 to form the locking systems 26 and 126 will now be described. The anchor panel 340 is arranged such that the first edge portion 380*b* is adjacent to the rear face 62,162 of the panel 32,132 and the return portion 380*e* is above the upper bar portions 54*a*,154*a* and 56*a*,156*a* of the insert projections 34,134. The first edge portion 380*b* may or may not be in contact with the rear face 62,162 of the panel 32,132 at this point.

The handle portion 42*c*,142*c* of the locking pin 42,142 is then grasped to displace the locking pin 42,142 along the lock axis A relative to at least one of the insert projections 34,134 and the anchor panel 40,140. The locking pin 42,142 thus passes through the lock openings 64,164 and 66,166 between the corner portions 54*c*,154*c* and 56*c*,156*c* of the insert projections 34,134 and the bearing portions 380*b* of the tension rods 380.

Figure 8B:
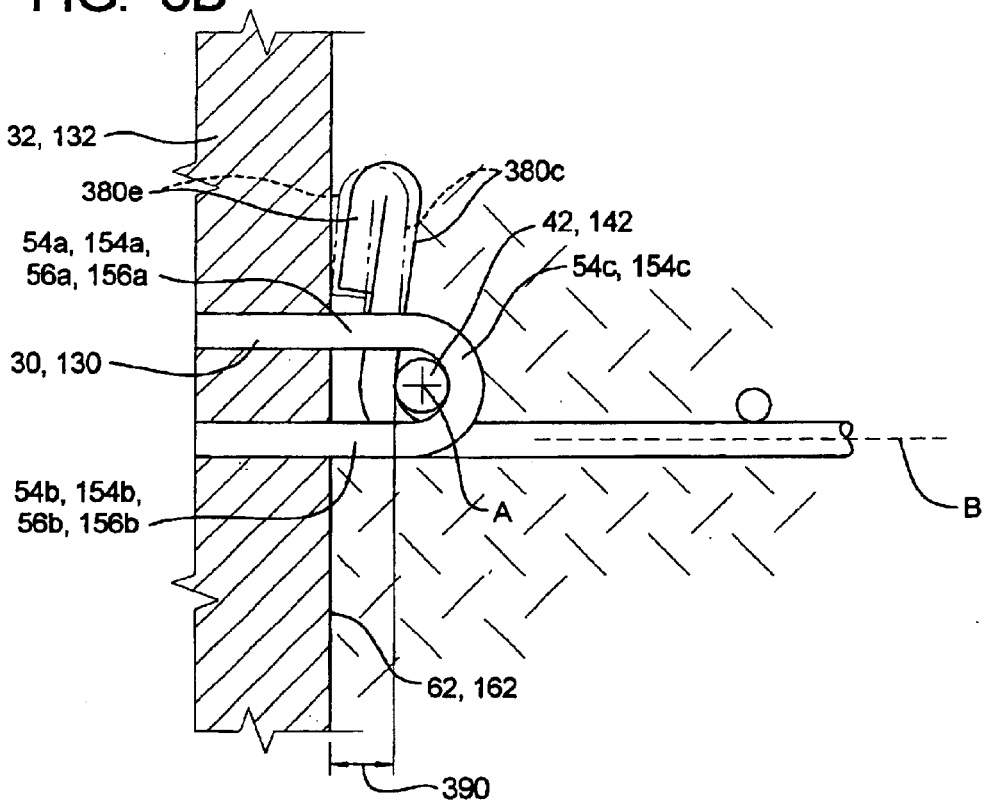
FIG. 8B is a slightly enlarged view of a portion of FIG. 8 depicting a shape of tension rods thereof upon initial installation (solid lines) and after loads are applied to the wall panel during backfilling (broken lines)

At this point, the locking pin 42,142 engages the bearing portions 380*c* of the tension rods 380 to prevent movement of the tension rods 380 in the direction of the anchor axis B relative to wall panel 32,132. As perhaps best shown by broken lines in FIG. 8B, after backfilling the wall 44, 144 as described above the return portions 380*e* engage the rear face 62,162 of the panel 32, 132 to prevent the tension rods 380 from straightening and pulling out from behind the locking pin 42,142. In addition, a gap 390 between the locking pin 42,142 and the rear face 62,162 is too small to allow the bearing and return portions 380*c* and 380*e* to pass through the gap 390. The locking system 36,126 thus forms a rigid connection between the anchor panel 340 and the wall panel 32,132 under normal anticipated loads.

It should be noted that the tolerances of the various components shown in FIG. 8 should be determined for a given set of operating conditions. These tolerances include the gauges or diameters of the metal bars used to form the insert 34,134, tension rods 380, and locking pin 42,142, the distance between the upper portions 54*a*,154*a* and 56*a*,156*a* and lower portions 54*b*,154*b* and 56*b*,156*b*, the distance between the rear face 62,162 and the corner portions 54*c*, 154*c* and 56*c*,156*c*, and the dimensions of the return portions 380*e*. In general, these tolerances should allow the locking pin 42,142 to be inserted along the lock axis A but not allow excessive movement of the insert 30,130 relative to the anchor panel 40,140 under expected loads. For clarity, the spaces between components of the locking system 26,126 resulting from the tolerances of the system 26,126 may be exaggerated in FIG. 8.

Figure 9:
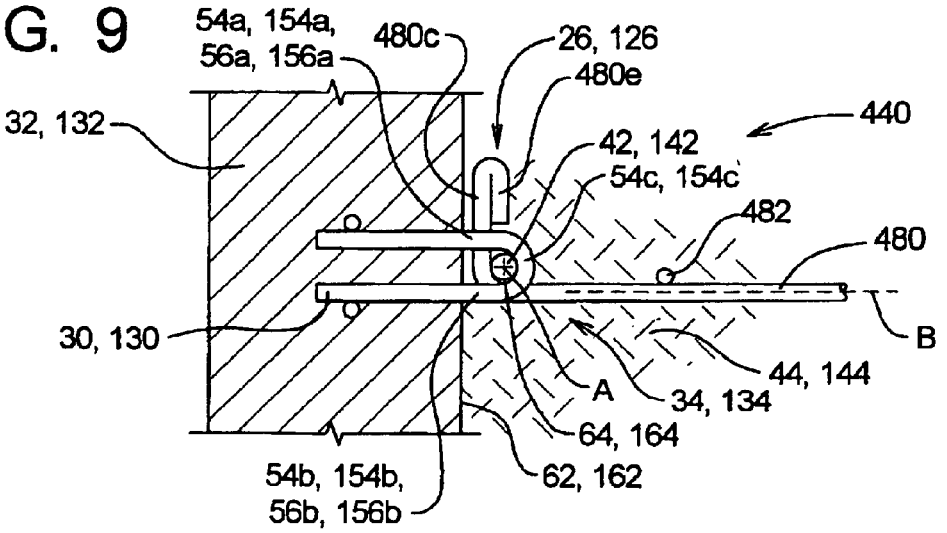
FIG. 9 is a side elevation view of a wall system comprising an insert embedded within a wall panel.
Figure 9A:
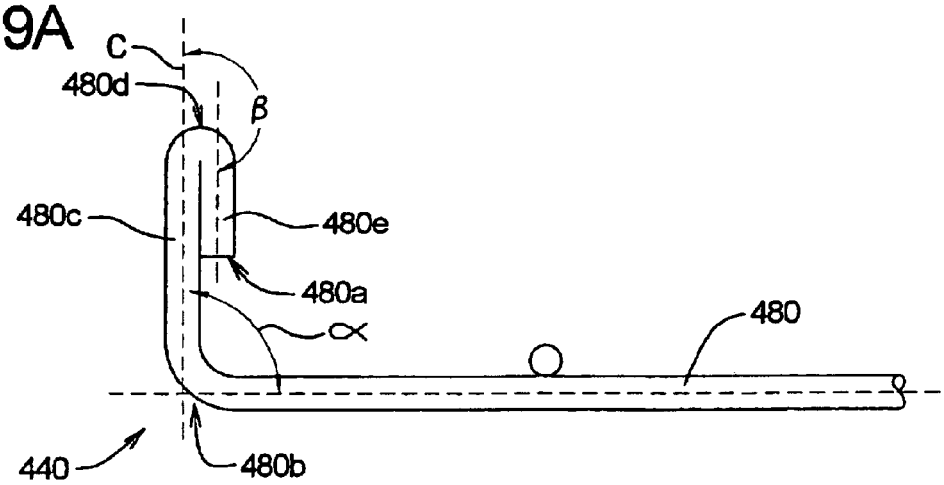
FIG. 9A is a side elevation view of the insert of FIG. 9.

Referring now to FIGS. 9 and 9A, depicted therein is another example of an anchor panel 440 that may be used in place of the anchor panels 40 or 140 as part of the retaining wall systems 20 and 120 described above. Like the anchor panels 40 and 140, the example anchor panel 440 is a mesh material made of welded rods and defines an anchor axis B. Any structure capable of preventing movement of the insert 30,130 relative to the earthen wall 44,144 under expected loads may be used to form the anchor panel 440.

The exemplary anchor panel 440 comprises a plurality of tension rods 480 and plurality of lateral rods 482 welded across the tension rods 480. Dirt forming the earthen wall 44,144 lies in openings defined by the tension and lateral rods 480 and 482 to inhibit movement of the anchor panel 440 relative to the earthen wall 44,144.

The tension rods 480 define proximal ends 480*a* that are, in use, adjacent to the wall panel 32, 132. Each tension rod 480 is bent at a first edge location 480*b* that is adjacent to the proximal end 480*a* of the rods to define bearing portions 480*c* of the tension rods 480. In addition, the example tension rods 480 are bent at a second edge location 480*d* to define a return portion 480*e* of the tension rods 480. As will be described in further detail below, the use of the return portion 480*e* obviates the need for a bearing bar such as the bearing bars 84,184, and 284 described above.

As perhaps best shown in FIG. 9A, the bearing portions 480*c* extend at an angle $\alpha$ of approximately 90° from the anchor axis B. The angle $\alpha$ may be within a first range of approximately 85° to 95° and in any event should be within a second preferred range of between approximately 70° to 110°.

The tension rod 480 is bent at the second edge location 480*d* to define a return portion 480*e* that extends along a return axis D at an angle $\beta$ relative to the bearing axis C. The angle $\beta$ is preferably approximately 180° such that the return axis D is substantially parallel to the bearing axis C. The angle $\beta$ may be within a first range of approximately 180° to 200° and in any event should be within a second preferred range of at least approximately 170° to at most approximately 210°. In any case, the return portion 480*e* of the tension rod 480 may be bent of to one side or the other of the bearing portion 480*c*; if the angle $\beta$ is greater than 180°, the return portion 480*e* of the tension rod 480 must be bent to one side or the other of the bearing portion 480*c*.

The method of using the example anchor panel 440 to form the locking systems 26 and 126 will now be described. The anchor panel 440 is arranged such that the first edge portion 480*b* is adjacent to the rear face 62,162 of the panel 32,132 and the return portion 480*e* is above the upper bar portions 54*a*,154*a* and 56*a*,156*a* of the insert projections 34,134. The first edge portion 480*b* may or may not be in contact with the rear face 62,162 of the panel 32,132 at this point.

The locking pin 42,142 is then grasped to displace the locking pin 42,142 along the lock axis A relative to at least one of the insert projections 34,134 and the anchor panel 40,140. The locking pin 42,142 thus passes through the lock openings 64,164 and 66,166 between the corner portions 54*c*,154*c* and 56*c*,156*c* of the insert projections 34,134 and the bearing portions 480*b* of the tension rods 480.

Figure 9B:
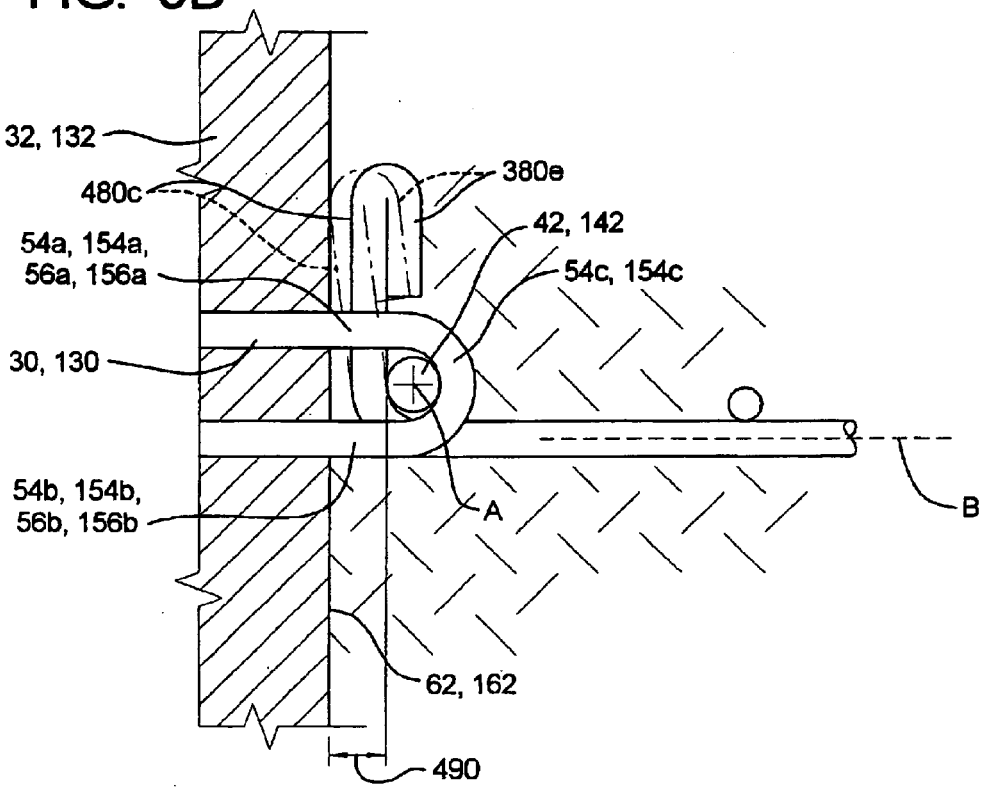
FIG. 9B is a slightly enlarged view of a portion of FIG. 9 depicting a shape of tension rods thereof upon initial installation (solid lines) and after loads are applied to the wall panel during backfilling (broken lines).

At this point, the locking pin 42,142 engages the bearing portions 480*c* of the tension rods 480 to prevent movement of the tension rods 480 in the direction of the anchor axis B relative to wall panel 32,132. As perhaps best shown by broken lines in FIG. 9B, after backfilling the wall 44, 144 as described above the return portions 480*e* engage the rear face 62,162 of the panel 32, 132 to prevent the tension rods 480 from straightening and pulling out from behind the locking pin 42,142.

In addition, a gap 490 between the locking pin 42,142 and the rear face 62,162 is too small to allow the bearing and return portions 480*c* and 480*e* to pass through the gap 490. The locking system 26,126 thus forms a rigid connection between the anchor panel 440 and the wall panel 32,132 under normal anticipated loads.

It should be noted that the tolerances of the various components shown in FIG. 9 should be determined for a given set of operating conditions. These tolerances include the gauges or diameters of the metal bars used to form the insert 34,134, tension rods 480, and locking pin 42,142, the distance between the upper portions 54*a*,154*a* and 56*a*,156*a* and lower portions 54*b*,154*b* and 56*b*,156*b*, the distance between the rear face 62,162 and the corner portions 54*c*, 154*c* and 56*c*,156*c*, and the dimensions of the return portions 480*e*. In general, these tolerances should allow the locking pin 42,142 to be inserted along the lock axis A but not allow excessive movement of the insert 30,130 relative to the anchor panel 40,140 under expected loads. For clarity, the spaces between components of the locking system 26,126 resulting from the tolerances of the system 26,126 may be exaggerated in FIG. 9.

The present invention may be embodied in forms other than those described above. In particular, the second bar 52 of the inserts 30 can be elongated and used as part of a plurality of inserts. The plurality of inserts 30 connected by the second bar 52 can be used in a manner similar to that of the insert structure 130 described above. In addition, rather than using both a first rod 150 and a second rod 152, one of these rods could be eliminated. The third and fourth rods 154 and 156 could thus be formed by a single rod like the first rod 50 described above.

The scope of the present invention should thus be determined by the following claims and not the foregoing detailed description.

I claim:

1. A retaining wall system for stabilizing an earthen wall comprising:

at last one panel structure comprising a wall panel defining an exposed face and a rear face, and at least one insert, where a first portion of the insert is embedded within the wall panel and a second portion of the insert is spaced from the rear face of the wall panel such that the second portion and the rear face of the wall define at least one lock opening;

at least one anchor mesh panel comprising at least one tension member defining an anchor axis, where the at least one tension member is bent at a first edge location to define a substantially straight bearing portion defining a bearing axis, and at a second edge location to define a return portion, where the at least one tension member is bent such that the return portion extends at a first angle of between approximately 160° and 210° relative to the bearing axis; and at least one lock member; whereby the anchor mesh panel is arranged such that the first edge portion of the tension member is adjacent to the rear face of the panel structure and at least a portion of the bearing portion of the at least one tension member is located within the lock opening;

the at least one lock member is inserted through the at least one lock opening to engage the bearing portion of the at least one tension member and the second portion of the insert to inhibit relative movement between the anchor mesh panel and the wall panel;

one of the bearing portion and the return portion of the at least one tension member engages the rear face of the wall panel;

the lock member engages the engaging portion of the at least one tension member at the edge portion to prevent the bearing portion from being withdrawn from the lock opening; and a gap is formed between the rear face of the wall panel and the lock member, where the gap is too small to allow a structure formed by the bearing portion and return portion of the at least one tension member to pass through the gap.

2. A retaining wall system as recited in claim 1, in which the at least one tension member is bent such that the bearing portion of the at least one tension member extends at a second angle of at least 72° to less than 90° relative to the anchor axis.

3. A retaining wall system as recited in claim 2, in which the second angle is between approximately 77° and 87°.

4. A retaining wall system as recited in claim 2, in which the second angle is approximately 82°.

5. A retaining wall system as recited in claim 1, in which the first angle is between approximately 170° to 200°.

6. A retaining wall system as recited in claim 1, in which the first angle is approximately 180°.

7. A retaining wall system for stabilizing an earthen wall comprising:

at last one panel structure comprising a wall panel defining an exposed face and a rear face, and at least one insert, where a first portion of the insert is embedded within the wall panel and a second portion of the insert is spaced from the rear face of the wall panel such that the second portion and the rear face of the wall define at least one lock opening;

at least one anchor mesh panel comprising at least one tension member defining an anchor axis, where the at least one tension member is bent at a first edge location to define a bearing portion, where the bearing portion is substantially straight along its entire length; and at least one lock member; whereby the anchor mesh panel is arranged such that the first edge portion of the tension member is adjacent to the rear face of the panel structure and at least a portion of the bearing portion of the at least one tension member is located within the lock opening;

the at least one lock member is inserted through the at least one lock opening to engage the bearing portion of the at least one tension member and the first portion of the insert to inhibit relative movement between the anchor mesh panel and the wall panel; and the bearing portion of the at least one tension member extends at a first angle of at least 72° to less than 90° relative to the anchor axis.

8. A retaining wall system as recited in claim 7, which the first angle is between approximately 77° and 87°.

9. A retaining wall system as recited in claim 7, in which the first angle is approximately 82°.

10. A retaining wall system as recited in claim 7, in which the at least on anchor mesh panel further comprises a bearing bar rigidly connected to the at least one tension member.

11. A retaining wall system as recited in claim 7, in which the at least one tension member is bent to form a return portion that extends at a second angle in a range of approximately 160° to 210° relative to a bearing axis defined by the bearing portion of the at least one tension member.

12. A retaining wall system as recited in claim 11, in which the second angle is in a range of approximately 170° to 200°.

13. A retaining wall system as recited in claim 11, in which the second angle is approximately 180°.

* * * * *